US010345029B2

(12) United States Patent
Ding et al.

(10) Patent No.: US 10,345,029 B2
(45) **Date of Patent: *Jul. 9, 2019**

(54) REFRIGERATOR

(71) Applicant: BSH HAUSGERAETE GMBH, Munich (DE)

(72) Inventors: Yuan Ding, Wuxi (CN); Jicong Song, Nanjing (CN); Changliang Zhao, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/319,026

(22) PCT Filed: Jul. 17, 2015

(86) PCT No.: PCT/IB2015/055425

§ 371 (c)(1),
(2) Date: Dec. 15, 2016

(87) PCT Pub. No.: WO2016/009398

PCT Pub. Date: Jan. 21, 2016

(65) Prior Publication Data

US 2017/0115049 A1 Apr. 27, 2017

(30) Foreign Application Priority Data

Jul. 18, 2014 (CN) ..... 2014 1 0346243
Jul. 28, 2014 (CN) ..... 2014 1 0364661

(51) Int. Cl.
*F25D 23/02* (2006.01)
*F25D 29/00* (2006.01)

(52) U.S. Cl.
CPC ..... *F25D 23/028* (2013.01); *F25D 29/005* (2013.01); *F25D 2323/021* (2013.01); *F25D 2400/361* (2013.01)

(58) Field of Classification Search
CPC ..... F25D 23/02; F25D 23/028; F25D 29/00; F25D 29/005; F25D 2323/02; F25D 2400/361
See application file for complete search history.

(56) References Cited

U.S. PATENT DOCUMENTS 2,567,565 A * 9/1951 Keeler ..... E05B 1/04 16/110.1
3,648,411 A * 3/1972 Saunders ..... E05B 1/0015 16/412

(Continued)

FOREIGN PATENT DOCUMENTS

CN 201803554 U * 4/2011 ..... F25D 23/02
DE 102011007318 * 10/2012 ..... F25D 23/028

(Continued)

OTHER PUBLICATIONS

JP2013178054 Translated Description, 8 pages.*
JP2004044980 Translated Description, 7 pages.*
DE102012200812 Translated Description, 13 pages.*

*Primary Examiner* — Andrew M Roersma
(74) *Attorney, Agent, or Firm* — Laurence A. Greenberg; Werner H. Stemer; Ralph E. Locher

(57) ABSTRACT

A refrigerator includes a door having a user interface electrical module and a user interface housing fixed to a heat insulating material. The user interface housing has a first receiving space which is open towards a side of the door to receive the user interface electrical module. A handle member includes a covering portion for closing the open side of the first receiving space and a grip portion located in front of a handle groove. A rear wall of the user interface housing facing the handle groove forms a rear boundary of the handle groove. The thickness of the heat insulating material of the door which is occupied by the handle groove can therefore be reduced.

20 Claims, 6 Drawing Sheets

(56) References Cited

U.S. PATENT DOCUMENTS 3,766,598 A * 10/1973 Roberts ..... A47B 95/02 16/444
3,995,349 A * 12/1976 Roberts ..... A47B 95/02 16/412
5,704,093 A * 1/1998 Trulaske, Sr. ..... A47B 95/02 16/443
8,485,617 B2 * 7/2013 Park ..... F25D 23/028 312/405.1
8,523,304 B2 * 9/2013 Kim ..... F25D 29/005 312/405.1
8,567,885 B2 * 10/2013 Lee ..... E05D 7/0027 312/405
8,752,919 B2 * 6/2014 Park ..... F25D 23/028 312/405.1
9,459,041 B2 * 10/2016 Park ..... F25D 23/028
2012/0326587 A1 12/2012 Jeong et al.
2013/0125345 A1 * 5/2013 Specht ..... E05B 1/0015 16/413
2014/0208657 A1 * 7/2014 Kim ..... F25D 23/02 49/460
2015/0192353 A1 * 7/2015 Lee ..... F25D 23/028 312/325
2016/0003519 A1 * 1/2016 Kim ..... F25D 29/005 362/307
2017/0115049 A1 * 4/2017 Ding ..... F25D 23/028
2017/0138658 A1 * 5/2017 Ding ..... F25D 23/028
2017/0146281 A1 * 5/2017 Ding ..... F25D 23/028
2017/0159994 A1 * 6/2017 Ding ..... F25D 23/028
2017/0176091 A1 * 6/2017 Becke ..... F25D 23/028
2017/0184336 A1 * 6/2017 Becke ..... F25D 23/028
2017/0191737 A1 * 7/2017 Becke ..... F25D 23/028

FOREIGN PATENT DOCUMENTS

DE 102012200810 * 7/2013 ..... F25D 23/028
DE 102012200812 A1 7/2013
EP 2264387 A2 * 12/2010 ..... F25D 23/028
EP 2405216 A1 * 1/2012 ..... F25D 23/028
EP 2538160 A2 12/2012
EP 2859814 A1 * 4/2015 ..... A47B 95/02
JP 2004044980 A * 2/2004 ..... F25D 2400/18
JP WO 2010100925 A1 * 9/2010 ..... F25D 23/028
JP 2013178054 A 9/2013
JP WO 2014034433 A1 * 3/2014 ..... F25D 29/005
WO WO 2007060188 A2 * 5/2007 ..... F24C 7/082
WO WO 2009080494 A1 * 7/2009 ..... F25D 23/02
WO WO-2011018268 A1 * 2/2011 ..... F25D 23/02

* cited by examiner

REFRIGERATOR

BACKGROUND

Technical Field

The present invention relates to a refrigerator, and more particularly to a refrigerator with a user interface electrical module disposed on a door.

Related Art

JP 2013-178054 A discloses a refrigerator door, including a door body having a heat insulating material. A step member making a front surface concaved is formed on a side cover of a right end portion of the door body. A handle member protruding towards the right side is installed on an installation surface of a side facing the step member by using a screw. A handle groove extending on the entire height of the door is formed between the handle member and the step member. A user interface apparatus is disposed in an intermediate region, viewed from a longitudinal direction, of the door body, and located behind a glass plate of the door body.

SUMMARY

An object of the present invention is to provide a refrigerator having a handle groove in a door, wherein influences of a handle groove on a thickness of a heat insulating material of the door may be reduced.

The object can be achieved through features in the independent claim. Preferable embodiments of the present invention are subject matters of the accompanying drawings, the specification and the dependent claims.

An aspect of the present invention relates to a refrigerator, including a door, the door including a user interface electrical module; a user interface housing, the user interface housing having a first receiving space, and the first receiving space being open towards a side of the door to receive the user interface electrical module; and a handle member, the handle member including a grip portion located in front of a handle groove; characterized in that, the handle member is detachably connected to the user interface housing to close the open side of the first receiving space, the user interface housing has a first rear wall combined with a heat insulating material of the door, and the first rear wall faces the handle groove and forms a rear boundary of the handle groove.

The rear boundary of the handle groove is defined directly through the first rear wall of the user interface housing, and when the first rear wall and a front wall of a door body have the same depth, the handle groove of the door according to the present invention can have a greater thickness, which helps to reduce influences of a handle groove on the thickness of a heat insulating material of the door. In addition, as the handle member can close the first receiving space, it is unnecessary to additionally dispose a member for closing the first receiving portion.

The present invention is applicable to refrigerators with various different structures, for example, the present invention is applicable to a side-by-side combination refrigerator having a first storage compartment and a second storage compartment disposed side by side, is applicable to a refrigerator having a first storage compartment and a second storage compartment disposed up and down, and may have a refrigerator where a pair of doors close the same storage compartment.

A storage compartment of a refrigerator may be used for storing food and/or wine, for example, the refrigerator may have at least one storage compartment purely for storing wine.

The door may be a rotatable door pivotally connected to the main body of the refrigerator, and may also be a drawer-type door drawably connected to the main body.

The door may close one or more storage compartments of the refrigerator, and may also close a part of one or more storage compartments.

In one possible embodiment, the handle groove may be disposed close to a longitudinal side of the door. In one alternative embodiment, the handle groove is disposed close to a horizontal side portion of the door, for example, the top or the bottom.

The user interface electrical module may include an input unit for receiving a user input instruction and/or an output unit displaying information for a user. The user interface electrical module may be completely located in a first receiving space, or one part is located in the first receiving space, and the other part is located outside the first receiving space. The user interface electrical module may include a touch unit to receive a touch instruction of the user, and in one alternative embodiment, the user interface electrical module may also receive an instruction of the user through a key or other input apparatuses.

Other individual features or those combined with other features to be regarded as characteristics of the present invention are set forth in the following appended claims.

In one possible embodiment, the user interface housing has opposite end walls, and the pair of end walls define a corresponding end boundary of the handle groove, respectively. So, a handle groove with a greater length can be obtained without occupying the heat insulating material more.

In one possible embodiment, the handle member may have a substantially L-shaped cross section.

In one possible embodiment, a fore-and-aft thickness of the grip portion may gradually increase in a depth direction of the handle groove. This helps to increase the width of the inlet of the handle groove, and also facilitates the user's hand which extends into the handle groove to grip the grip portion. At the same time, this also helps to increase strength of the grip portion.

In one possible embodiment, the door may include a front panel, the user interface electrical module is connected with the front panel, a gap may be formed between a front surface of the grip portion and the front panel, and the gap is not less than 0.2 mm and not greater than 1 mm, especially between 0.2 mm and 0.6 mm. Therefore, the front portion of the grip portion is disposed adjacent to the front panel. In this way, not only can foreign matter's entry into the gap be reduced, but also the probability may be greatly reduced that the front panel and the user interface electrical module are in poor contact possibly caused by a force applied to the front panel by the grip portion when the grip portion is gripped to pull the door forward.

In one possible embodiment, the handle member includes a covering portion for closing the open side of the first receiving space, and the covering portion is connected to an inner end of the grip portion.

In one possible embodiment, the covering portion may be at least substantially perpendicular to a front panel located in front of the user interface electrical module and the handle member. The front panel may form at least most of the front surface of the door, and may also only cover a user interface of the handle member and an operation center where the handle member is located.

In one possible embodiment, the door may include a fixing member for fixing the handle member to the user interface housing, and the fixing member passes through a through hole located at the covering portion to be connected with the user interface housing. This not only facilitates reliable fixing of the handle member, but also can hide the fixing member deep into the handle groove not easily seen by the user as the handle member is fixed to the user interface housing through the covering portion.

In one possible embodiment, the user interface housing may include a pair of bosses located on one corresponding side of the first receiving space, and two ends of the covering portion are respectively fixed to the bosses correspondingly. In a manner of disposing bosses in the user interface housing, the size and position of the first receiving space in the user interface housing can be determined through positions and sizes of the bosses, so that, whether the sizes of the user interface electrical module and the handle groove (e.g., length) vary or not, a portion of the user interface housing for connecting other members of the door body still can have a structure flat and easy for connections between the members.

In one possible embodiment, the user interface housing may have a support portion, and the support portion supports a front end of one side of the covering portion which side is away from the handle groove. So, a tendency may not occur that the covering portion and the grip portion rotate around a certain region of one side of the covering portion away from the handle groove when the user grips the grip portion to open the door, which not only helps to reliably fix the handle member onto the door, but also helps to prevent a situation from occurring where the grip portion moves to butt the front panel forward to cause poor contact between the front panel and the user interface housing. The support portion may be supported on the covering portion by directly contacting the covering portion, and may also be indirectly supported on the covering portion.

In one possible embodiment, the user interface housing may have a wall abutting against the entire width of one side of the covering portion away from the handle groove, so that a front end of one side of the covering portion facing the first receiving space is supported.

In one possible embodiment, the user interface housing may include a second rear wall which defines the rear boundary of the first receiving space, a step is formed between the first rear wall and the second rear wall, and a distance between the second rear wall and a front surface of the door is less than that between the first rear wall and the front surface of the door. This may make the portion of the door corresponding to the first receiving space still have a greater thickness of the heat insulating material while make the handle groove have a relatively greater fore-and-aft depth.

In one possible embodiment, the door may include a concave portion concaved backwards from a front surface of the door, the handle groove is accessible through the concave portion, and a rear boundary of the concave portion is formed by the first rear wall. So it is possible that the handle groove and the concave portion have smooth continuous rear boundaries.

In one possible embodiment, the concave portion, the handle groove and the first receiving portion are sequentially disposed side by side in the depth direction of the handle groove in the user interface housing. This not only facilitates manufacturing of the door, but also can obtain the length of the handle groove and the concave portion meeting the demands in the event that the user interface housing has a compact structure as the first receiving space will not occupy the length of the handle groove and the concave portion.

In one possible embodiment, the handle member may include a metal reinforcer for at least reinforcing the grip portion. This particularly helps to solve the technical problem that the front panel and the user interface electrical module are in poor contact possibly caused by a force applied to the front panel by deformation of the handle member, especially the grip portion in a direction perpendicular to the direction where the hand is inserted into the handle groove. As the metal reinforcer can significantly reduce deformation of the grip portion, it is possible that the front panel and the grip portion maintain a tiny distance therebetween and even are in direct contact.

In one embodiment, the reinforcer is received in one receiving space of the handle member. In one possible embodiment, the reinforcer is integrally injection-molded with the handle member as inserts.

In one possible embodiment, the reinforcer may extend on substantially the entire length of the grip portion.

In one possible embodiment, the door may include a seal, and the seal includes a sealing portion disposed along at least one side of the covering portion. The sealing portion may be located between the front panel and the handle member, between the first rear wall and the handle member, and/or between upper and lower end walls and the handle member, so that possibility can be reduced that water vapor, dust and the like enter into the first receiving space to reduce the service life of electric parts.

The structure and other invention objectives as well as beneficial effects of the present invention will be more comprehensible with reference to the accompanying drawings and the description about the preferable embodiments.

BRIEF DESCRIPTION OF THE DRAWINGS

As a part of the specification and for facilitating further comprehension of the present invention, the following accompanying drawings illustrate specific implementation manners of the present invention, and describe the principle of the present invention together with the specification.

DETAILED DESCRIPTION

Figure 1:
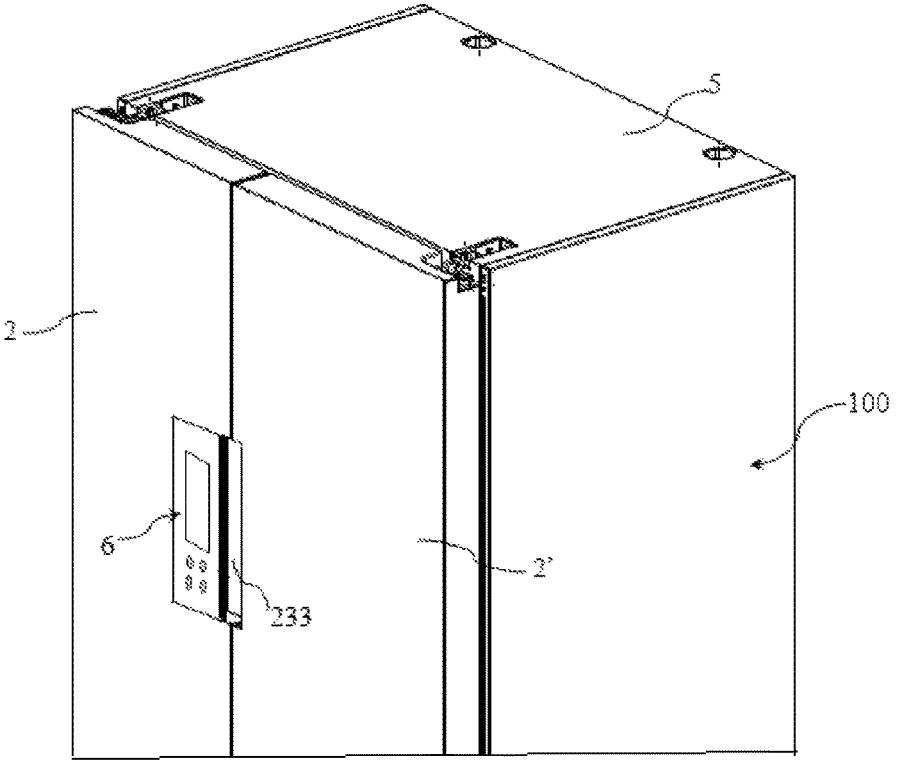
FIG. 1 is a schematic partial perspective view of a refrigerator according to a preferable embodiment of the present invention.

FIG. 1 is a schematic perspective view of a refrigerator 100 according to a preferable embodiment of the present invention. As shown in FIG. 1, the refrigerator 100 includes a main body 5 having a first storage compartment (not shown) and a second storage compartment (not shown) disposed side by side. The refrigerator 100 further includes a pair of oppositely-opened doors 2, 2' connected to the main body 5 to respectively close the corresponding storage compartments.

Figure 2:
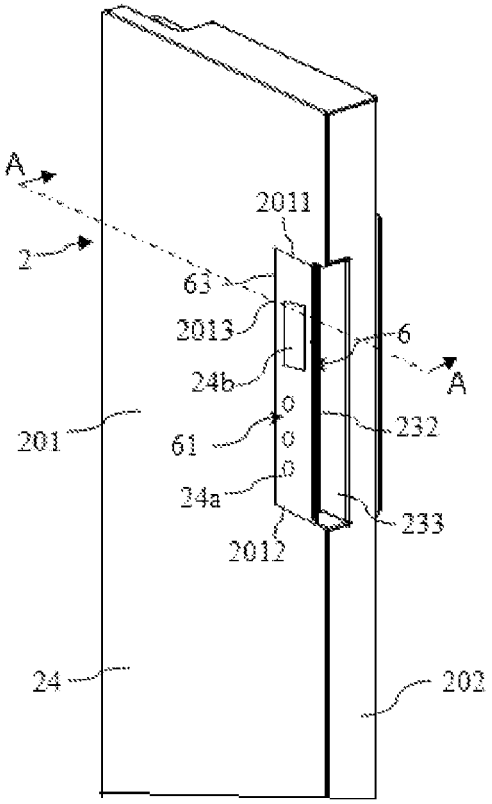
FIG. 2 is a schematic partial perspective view of a door according to a preferable embodiment of the present invention.
Figure 3:
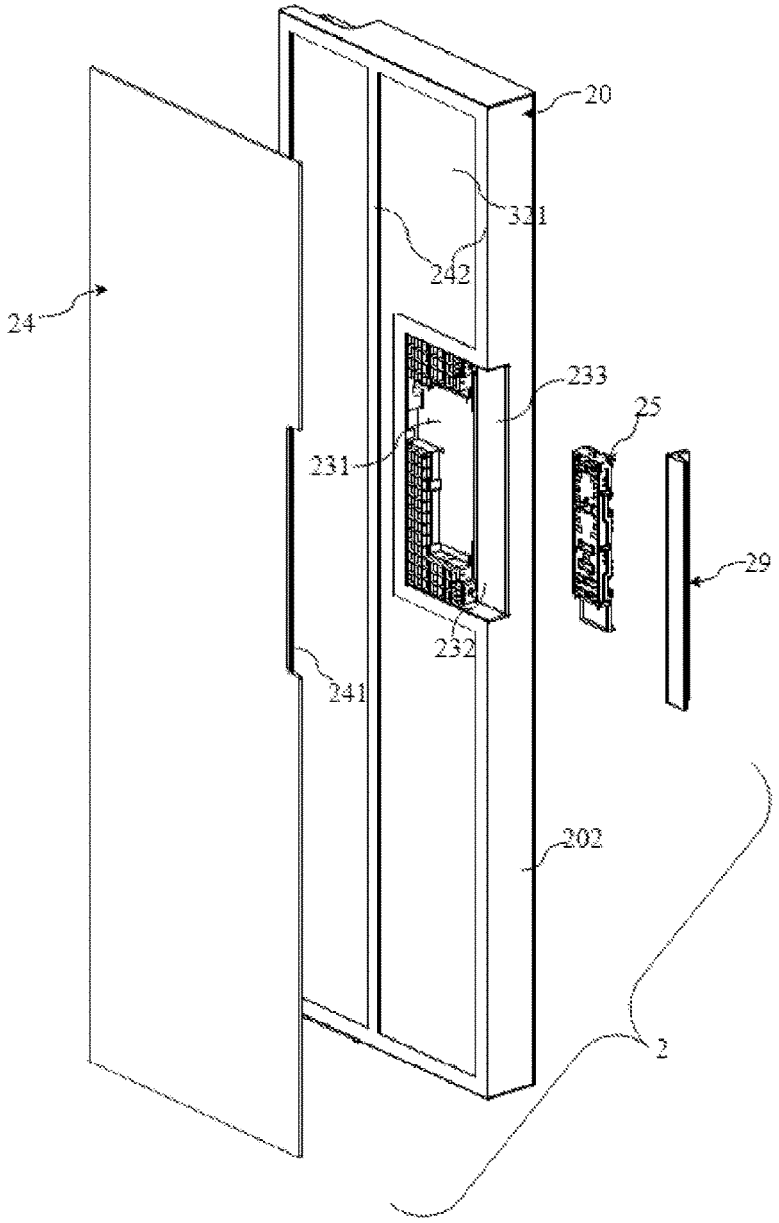
FIG. 3 is a partial exploded view of a door according to a preferable embodiment of the present invention.
Figure 7:
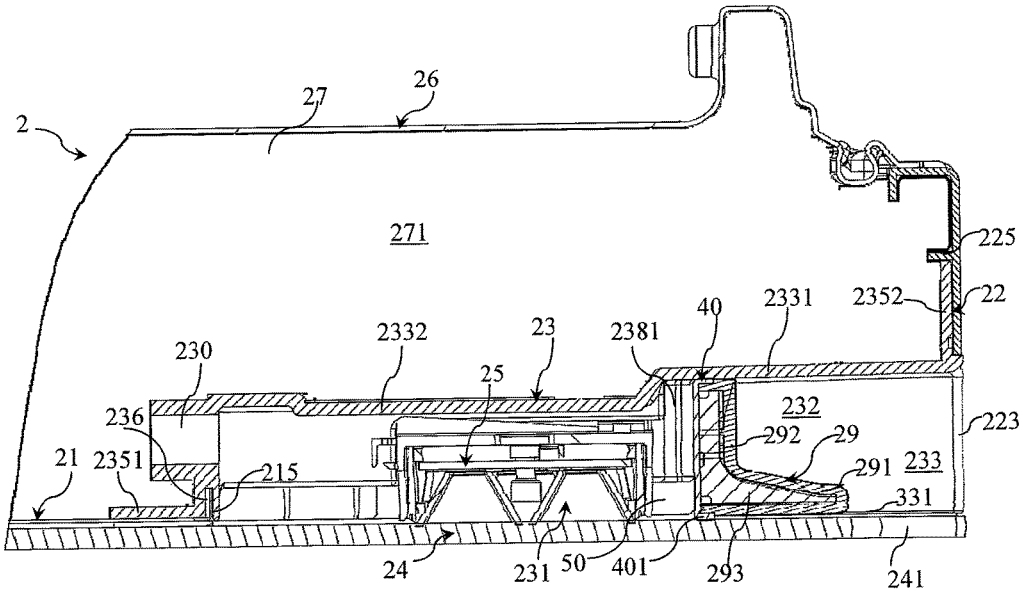
FIG. 7 is a partial sectional view along the A-A line in FIG. 2.

Referring to FIG. 2, FIG. 3 and FIG. 7 in combination with FIG. 1, the door 2 has an integrated operation center 6. The operation center 6 includes a user interface 61 and a handle groove 232 integrated into the operation center 6. When opening or closing the door 2, the user's hand can extend into the handle groove 232. The operation center 6 further includes a concave portion 233, and the user's hand enters into the handle groove 232 through the concave portion 233.

The concave portion 233 extends along part of the length of the door 2, and is at a distance from a top surface 203 and a bottom surface (not shown) of the door 2.

The user interface 61 is disposed to be used for receiving input and output information of the user, and the information, for example, includes setting information about the refrigerator 100 and/or information of food stored in the refrigerator 100, etc. The user interface 61 includes a plurality of touch regions 24*a* and a display region 24*b* (merely shown in FIG. 1) formed on the front panel 24. The touch regions 24*a* can, as shown in FIG. 2, be separated from the display region 24*b*, and can also be located in the display region 24*b*. the user interface 61 includes a user interface electrical module 25 located behind the touch regions 24*a* and the display region 24*b*. The user interface electrical module 25 includes a light source, and when the light source is opened, light can transmit through the display region 24*b*.

As shown in FIG. 7, the concave portion 233 is open towards a front surface 201 and a side surface 202 of the door 2. The concave portion 233, the handle groove 232 and the user interface electrical module 25 are arranged side by side in a depth direction (which is also a transverse direction of the door 2 in this embodiment) of the handle groove 232. Viewed from the front, visual elements of the user interface 61, for example, the touch regions 24*a* and the light-transmitting display region 24*b*, the handle groove 232 and the concave portion 233 are disposed side by side in sequence in a transverse direction of the door 2.

As shown in FIG. 2, the front surface 201 of the door has an indication box 63 surrounding the touch regions 24*a* and the display region 24*b*. The indication box 63 is formed by indication lines 2011, 2012 and 2013.

In one alternative embodiment, the door 2 may also not be provided with the indication box 63.

The door 2 includes a door body 20 having a heat insulating material 27, and the front panel 24 covers the front of the door body 20. The front panel 24 has an edge notch 241 located in front of the concave portion 233, so as to expose the concave portion 233 to the front.

The front panel 24 may be made from glass or appearance glass resin. The front panel 24 may be bonded to the door body 20 through a bonding apparatus 242 disposed at least around a front edge of the door body 20.

The indication lines 2011 and 2012 may be connected with upper and lower edges of the edge notch 241, which may be formed on the front panel 24 through printing.

Figure 4:
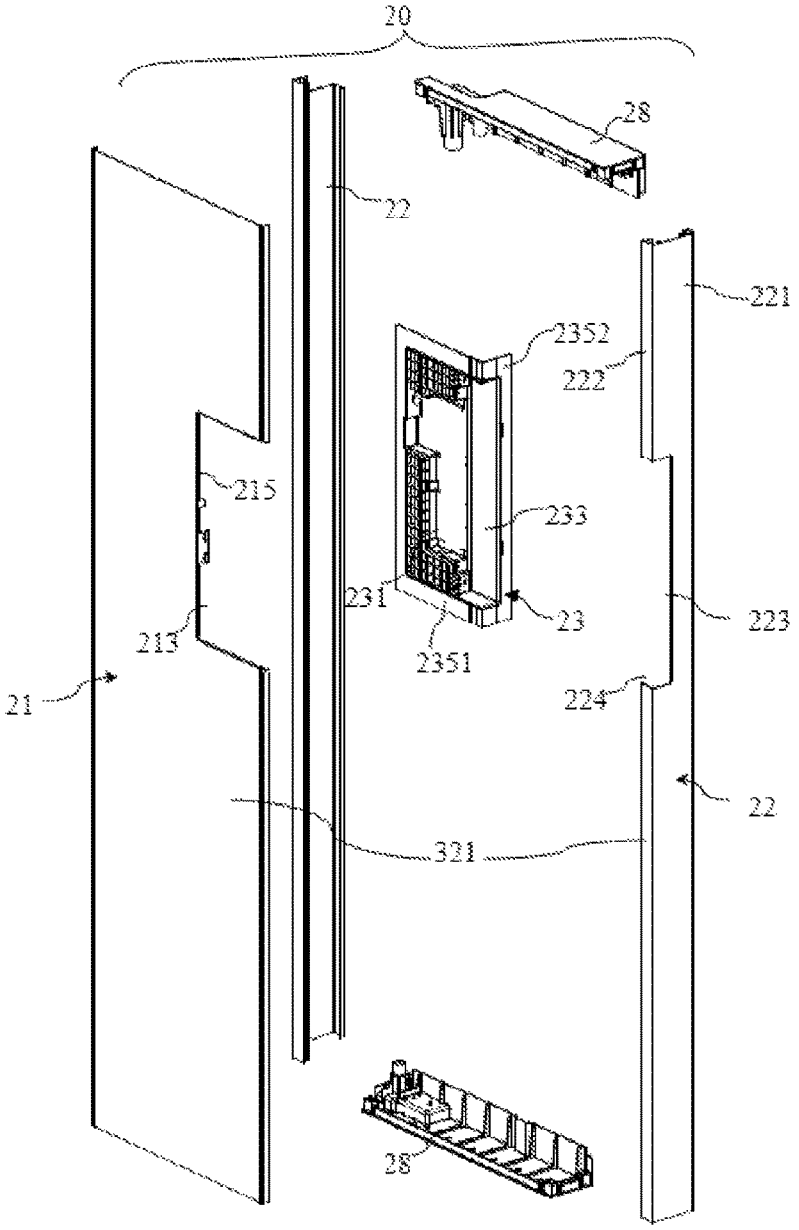
FIG. 4 is a partial exploded view of a door body according to a preferable embodiment of the present invention.

Referring to FIG. 4 and FIG. 7, the door body 20 includes a metal sheet 21, a pair of door rims 22 connected to one corresponding longitudinal side of the metal sheet 21, upper end lower end handle members 28 respectively connected to an upper end and a lower end of the metal sheet 21 and a user interface housing 23 connected to the metal sheet 21 and a corresponding door rim 22. The heat insulating material 27 is filled into a heat insulating space 271 encircled by the metal sheet 21, the door rims 22, the end handle members 28, the user interface housing 23 and a door liner 26.

In this embodiment, each door rim 22 has a side wall 221 forming a main portion thereof and a front strip 222 connected to a front end of the side wall 221 and extending inwards.

The metal sheet 21 is connected to the door rims 22 to make the front strip 222 and the metal sheet 21 together form a front wall 321 of the door body 20 located in front of the liner 26. Each front strip 222 is located on one corresponding side of the metal sheet 21.

The front wall 321 has a first opening 331 (shown in FIG. 7), and the first opening 331 is formed by a first edge opening 213 located on the metal sheet 21 and a second edge opening 224 located on the right door rim 22.

The side wall 221 has a second opening 223, and the first opening 331 and the second opening 223 are in communication at a connecting angle between the front wall 321 and the side wall 221.

The user interface housing 23 is connected to the front wall 321 and the side wall 221 to close the first opening 331 and the second opening 223 relative to the heat insulating space 271, that is, the heat insulating space 271 can be closed at the first opening 331 and the second opening 223 due to the user interface housing 23.

Figure 5:
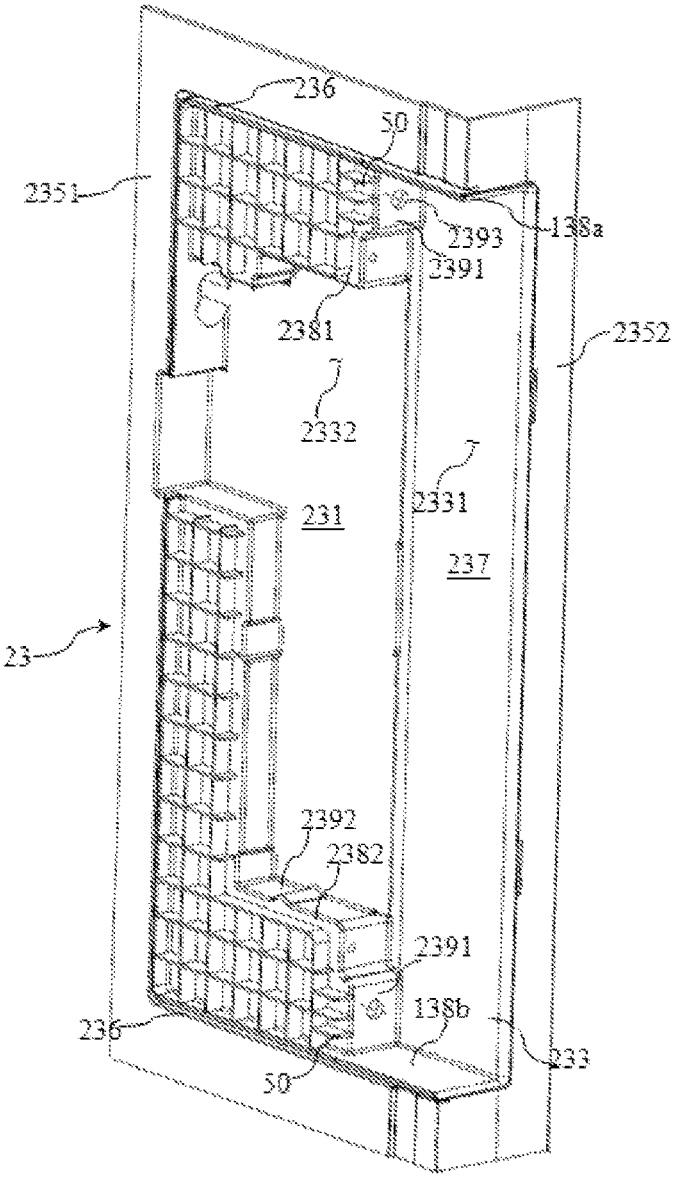
FIG. 5 is a schematic perspective view of a user interface housing according to a preferable embodiment of the present invention.

Referring to FIG. 5 and FIG. 7 in combination with FIG. 4, the user interface housing 23 includes a first connecting flange 2351 for connecting a rear surface of the front wall 321 and a second connecting flange 2352 connected with an inner surface of the side wall 221. The first connecting flange 2351 and the second connecting flange 2352 are connected with each other and perpendicular to each other.

The first connecting flange 2351 and the second connecting flange 2352 respectively include three connecting strips, and the connecting strips are disposed along corresponding edges of the first opening 331 and the second opening 223.

The user interface housing 23 has a connecting slot 236 located on an inner side of the first connecting flange 2351. The metal sheet 21 has a turnup 215 disposed along the first edge opening 213. The turnup 215 is inserted into the connecting slot 236 to position the user interface housing 23 and the metal sheet 21 before a foaming procedure of the door body 20.

As shown in FIG. 7, the door rim 22 includes a protruding portion 225 protruding inwards from the side wall 221, and an end of the second connecting flange 2352 abuts against the protruding portion 225. So the user interface housing 23 can be extruded forward, which helps to in-place connection of the turnup 215 and the connecting slot 236, and also helps to prevent a foaming agent from leaking from the heat insulating space 271. It can be expected that it is unnecessary to use an additional foaming leakage measure between the protruding portion 225 and the second connecting flange 2352.

The user interface housing 23 has a first receiving space 231 for receiving the user interface electrical module 25. The first receiving space 231 is open towards the first opening 331, so that the user interface electrical module 25 may be connected with the front panel 24 located in front of the first receiving space 231, to receive an instruction input by the user by touching the front panel 24.

The user interface housing 23 includes a second receiving space 237 for forming the handle groove 232 and the concave portion 233 and disposed side by side with the first receiving space 231. The handle groove 232 and the concave portion 233 are disposed left and right side by side in the second receiving space 237, and they are one part of the second receiving space 237 respectively.

The first receiving space 231, the handle groove 232 and the concave portion 233 are located in the user interface housing 23. The concave portion 233, the handle groove 232 and the first receiving space 231 are sequentially disposed side by side along a depth direction of the handle groove 232.

The first receiving space 231 has an opening open towards the second receiving space 237. The opening is closed by a handle member 29 detachably connected to the door body 20. When the handle member 29 is detached from the door 2, one side of the first receiving space 231 open towards the door 2 to be capable of receiving the user interface electrical module 25 or taking out the user interface electrical module 25 therefrom. Specifically, the user interface electrical module can be inserted into the first receiving space 231 or taken out from the first receiving space 231 through the handle groove 232. When the handle member 29 is fixed to the door 2, a side opening of the first receiving space 231 is closed, so that the user's hand cannot extend into the first receiving space 231.

The user interface housing 23 may also have a through-line hole 230 for threading a cable (not shown).

The user interface housing 23 includes a first rear wall 2331 located at the back of the handle groove 232 and the concave portion 233 and a second rear wall 2332 corresponding to the first receiving space 231. The first rear wall 2331 and the second rear wall 2332 are disposed side by side and a front surface thereof faces the front panel 24. Rear sides of the first rear wall 2331 and the second rear wall 2332 are bonded to the heat insulating material 27.

A step may be formed between the first rear wall 2331 and the second rear wall 2332. Specifically, a distance between the first rear wall 2331 and the front panel 24 forming the front surface 201 of the door 2 is greater than that between the second rear wall 2332 and the front panel 24, as shown in FIG. 7.

The user interface housing 23 has a pair of upper end lower end walls 138*a* and 138*b* respectively connected to one corresponding end of the first rear wall 2331. The upper end lower end walls 138*a* and 138*b* extend substantially horizontally.

The user interface housing 23 includes a plurality of bosses 2381 and 2382 adjacent to the first receiving space 231. The bosses 2381 and 2382 protrude towards the front panel 24. In a longitudinal direction, the bosses 2381 and 2382 are at least partially located between the upper end wall 138*a* and the first receiving space 231 or between the lower end wall 138*b* and the first receiving space 231, so that the first receiving space 231 has a length less than that of the handle groove 232 and the concave portion 233.

The bosses 2381 and 2382 include a pair of first boss walls 2391 connected with the first rear wall 2331 and extending forward perpendicular to the first rear wall 2331.

The bosses 2381 and 2382 further include a pair of second boss walls 2392 facing the first receiving space 231. The second boss walls 2392 extend forward from the second rear wall 2332. The second boss walls 2392 form upper and lower boundaries of the first receiving space 231.

The handle member 29 includes a grip portion 291 located in front of the handle groove 232. The grip portion 291 forms a front boundary of the handle groove 232, and when the user's hand extends into the handle groove 232, the user's fingers extending into the handle groove 232 can grip the grip portion 291, to open the door 2. Generally, some fingers of the user are pressed on a rear surface of the grip portion 291, and another finger (e.g., thumb) is pressed on the front panel 24 located in front of the grip portion 291, so as to apply a force to open the door 2.

The handle member 29 includes a covering portion 292 for closing the open side of the first receiving space 231. The covering portion 292 is connected to an inner side of the grip portion 291 and extends backwards.

A rear side of the grip portion 291 is opposite the first rear wall 2331 of the user interface housing 23. That is, the first rear wall 2331 of the user interface housing 23 facing the handle groove 232 forms the rear boundary of the handle groove 232.

In this embodiment, the front surface of the first rear wall 2331 is basically flat, and is basically parallel to the front surface 201 of the door 2.

The first rear wall 2331 extends to and connects the side surface 202 of the door 2, thus forming a rear boundary of the concave portion 233. That is to say, the rear boundaries of the concave portion 233 and the handle groove 232 are defined by the common first rear wall 2331.

The covering portion 292 separates the handle groove 232 and the first receiving space 231. One side of the covering portion 292 can be at least substantially perpendicular to a front panel 24 located in front of the user interface electrical module 25 and the handle member 29. In this embodiment, the covering portion 292 is substantially plate-like.

The grip portion 291 has a front surface parallel to the front panel 24. Thus, the handle member 29 has a substantially L-shaped cross section.

The front panel 24 covers the user interface electrical module 25 and the grip portion 291. In the embodiment of the present invention, the front surface of the grip portion 291 is adjacent to the front panel 24 but maintains a tiny gap with the rear surface of the front panel 24, for example, it is adjacent to the front panel 24 with a gap between the grip portion 291 and the front panel 24 in a fore-and-aft direction not less than 0.2 mm but not greater than 1 mm. Preferably, the gap between the front surface of the grip portion 291 and the front panel 24 is between 0.2 mm and 0.6 mm, for example, the gap is 0.6 mm.

The rear surface of the grip portion 291, that is, the surface facing the handle groove 232, is a slope. The slope is disposed such that a distance between the front surface and the rear surface of the grip portion 291 (i.e., the fore-and-aft thickness of the grip portion 291) gradually increases along a depth direction of the handle groove 232. That is to say, the thickness of the grip portion 291 gradually increases from a free end of the grip portion 291 to a direction of a connecting end where the grip portion 291 is connected with the covering portion 292. So, the fore-and-aft width of the handle groove 232 gradually decreases in a direction where the user's fingers are inserted, and the handle groove 232 has a relatively greater width in the inlet end.

Two ends of the handle member 29 are connected with the corresponding end walls 138*a* and 138*b*, and the end walls 138*a* and 138*b* have a portion exposed to the handle groove 232. Therefore, the end walls 138*a* and 138*b* respectively define upper and lower end boundaries of the handle groove 232. One side of the end walls 138*a* and 138*b* away from the handle groove 232 may face the heat insulating space 271 and be bonded to the heat insulating material 27.

The handle member 29 includes a metal reinforcer 293, especially for reinforcing strength of the grip portion 291. The reinforcer 293 may almost extend on the entire length of the grip portion 291, which thus helps to prevent the technical problem that the user interface electrical module 25 and the front panel 24 are in poor contact caused by a force applied to the front panel 24 by transverse deformation of the grip portion 291 in a process of opening the door.

The reinforcer 293 is fixed to the handle member 239 in a manner of being not exposed to the handle groove 232. In this embodiment, the handle member 29 can have a receiving space 294, and the reinforcer 293 is received in the receiving space 294.

The reinforcer 293 has a shape adapted to the grip portion 291 and the covering portion 292, which thus is also a substantially L-shaped cross section. The reinforcer 293 includes a first reinforcing portion 2931 extending in the grip portion 291 and a second reinforcing portion 2932 extending along the covering portion 292. The covering portion 292 may have a plurality of snap portions 2921 and 2922 for fixing the second reinforcing portion 2932.

The handle member 29 is fixed to the user interface housing 23. In this embodiment, the covering portion 292 is fixed to a pair of first boss walls 2391.

The door 2 includes a fixing member (not shown) for fixing the handle member 29 to the user interface housing 23, and the fixing member transversely passes through a first hole 295 located on the handle member 29 and a second hole 2393 located on the first boss wall 2391 to fix the covering portion 292 and the first boss wall 2931. The fixing member is preferably a screw.

The bosses 2381 and 2382 have a plurality of protruding walls 50 on the top thereof, the protruding walls 50 protrude forward from the top of the bosses 2381 and 2382, and one end towards the second receiving space 237 and the first boss wall 2391 are basically located in the same plane, thus one side of the covering portion 292 away from the handle groove 232 is supported by the user interface housing 23 on the entire width thereof. Particularly, a front end of the one side of the covering portion 292 away from the handle groove 232 is supported by a support portion formed by the protruding walls 50, which can prevent the handle member 29 from turning over towards the direction of the first receiving space 231 when the user's hand grips the grip portion 291 to open the door.

Figure 6:
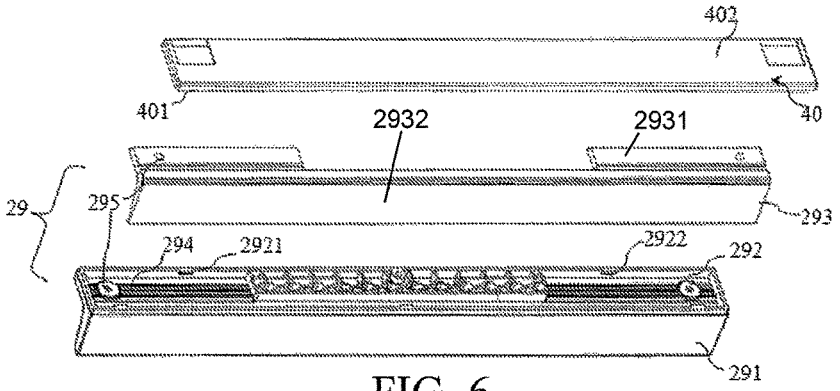
FIG. 6 is a schematic exploded view of a handle member and a seal according to a preferable embodiment of the present invention.

As shown in FIG. 6 and FIG. 7, the door may further include a seal 40, and the seal 40 includes annular sealing portions 401 disposed around four sides of the covering portion 292. The seal portions 401 are located between the front panel 24 and the handle member 29, between the first rear wall 2331 and the handle member 29, and between the upper and lower end walls 138*a* and 138*b* and the handle member 29, so that possibility can be reduced that water vapor, dust and the like enter into the first receiving space 231.

In this embodiment, the seal 40 includes a sheet-like base portion 402 over one side of the covering portion 292 facing the first receiving space 231. The sealing portions 401 are integrally formed on the base portion 402. After the seal 40 covers the covering portion 292, the sealing portions 401 are disposed around four sides of the covering portion 292.

Various embodiments of single parts described in combination with FIG. 1 to FIG. 7 can be combined in any given manner, to implement advantages of the present invention. In addition, the present invention is not limited to the illustrated embodiments, and generally, other means other than the illustrated means may also be used, as long as the means may also achieve the same effect.

What is claimed is:

1. A refrigerator door, comprising:

a front panel defining a front of said door;

a side of said door;

a heat insulating material of said door;

a user interface electrical module;

a handle groove having a rear boundary;

a user interface housing having a first receiving space with an open side facing towards said side of said door for receiving said user interface electrical module, said user interface housing having a first rear wall connected to said heat insulating material, and said first rear wall facing said handle groove and forming said rear boundary of said handle groove; and a handle member having a grip portion, said handle member being detachably connected to said user interface housing for closing said open side of said first receiving space;

said handle member including a covering portion for closing said open side of said first receiving space, and said grip portion of said handle member supported by said covering portion of said handle member;

said handle member being removable to open said open side of said first receiving space in a region located directly behind said front panel;

when said handle member is in a position closing said open side of said first receiving space, said covering portion separating said first receiving space from all of said handle groove; and wherein said handle member has an entirely L-shaped cross section.

2. The refrigerator door according to claim 1, wherein said user interface housing has a pair of opposite end walls, and each of said end walls defines a respective end boundary of said handle groove.

3. The refrigerator door according to claim 1, wherein said grip portion has an inner end, and said covering portion is connected to said inner end of said grip portion.

4. The refrigerator door according to claim 3, wherein said front panel covers said user interface electrical module and said handle member, said covering portion being at least substantially perpendicular to said front panel.

5. The refrigerator door according to claim 3, wherein said covering portion has a through hole formed therein for receiving a fixing member to be connected with said user interface housing for fixing said handle member to said user interface housing.

6. The refrigerator door according to claim 3, wherein said covering portion has a side facing away from said handle groove, said side has a front end, and said user interface housing has a support portion supporting said front end of said side of said covering portion facing away from said handle groove.

7. The refrigerator door according to claim 1, wherein said door includes said front panel, said front panel covers said user interface electrical module and said grip portion, said user interface electrical module is in contact with said front panel, said grip portion has a front surface, said front surface of said grip portion and said front panel form a gap therebetween, and said gap is not less than 0.2 mm and not greater than 1 mm.

8. The refrigerator door according to claim 1, wherein said door includes said front panel, said front panel covers said user interface electrical module and said grip portion, said user interface electrical module is in contact with said front panel, said grip portion has a front surface, said front surface of said grip portion and said front panel form a gap therebetween, and said gap is between 0.2 mm and 0.6 mm.

9. The refrigerator door according to claim 1, wherein:

said door has a front surface;

said user interface housing includes a second rear wall defining a rear boundary of said first receiving space;

a step is formed between said first rear wall and said second rear wall; and a distance between said second rear wall and said front surface of said door is less than a distance between said first rear wall and said front surface of said door.

10. The refrigerator door according to claim 1, wherein said first receiving space has sides, said user interface housing includes a pair of bosses each disposed on a respective one of said sides of said first receiving space, and said handle member has two ends each being fixed to a respective one of said bosses.

11. The refrigerator door according to claim 1, wherein:

said door has a front surface;

said door has a concave portion concaved backwards from said front surface of said door, said concave portion has a rear boundary formed by said first rear wall; and said handle groove is accessible through said concave portion when said handle member is in the position closing said open side of said first receiving space.

12. The refrigerator door according to claim 11, wherein said concave portion, said handle groove and said first receiving portion are sequentially disposed side by side in a depth direction of said handle groove in said user interface housing.

13. The refrigerator door according to claim 1, wherein said handle member includes a metal reinforcement member for reinforcing at least said grip portion.

14. The refrigerator door according to claim 13, wherein said reinforcement member extends over substantially an entire length of said grip portion.

15. The refrigerator door according to claim 1, wherein said handle groove perpendicularly extends away from said front panel to a greater extent than said first receiving space.

16. A refrigerator door, comprising:

a front panel defining a front of said door;

a side of said door;

a heat insulating material of said door;

a user interface electrical module;

a handle groove having a rear boundary;

a user interface housing having a first receiving space with an open side facing towards said side of said door for receiving said user interface electrical module, said user interface housing having a first rear wall connected to said heat insulating material, and said first rear wall facing said handle groove and forming said rear boundary of said handle groove; and a handle member having a grip portion, said handle member being detachably connected to said user interface housing for closing said open side of said first receiving space;

said handle member including a covering portion for closing said open side of said first receiving space, and said grip portion of said handle member supported by said covering portion of said handle member;

said handle member being removable to open said open side of said first receiving space in a region located directly behind said front panel;

when said handle member is in a position closing said open side of said first receiving space, said covering portion separating said first receiving space from all of said handle groove; and wherein said grip portion has a front and back thickness that gradually increases in a depth direction of said handle groove.

17. The refrigerator door according to claim 16, wherein said user interface housing has a pair of opposite end walls, and each of said end walls defines a respective end boundary of said handle groove.

18. The refrigerator door according to claim 16, wherein said grip portion has an inner end, and said covering portion is connected to said inner end of said grip portion.

19. The refrigerator door according to claim 18, wherein said front panel covers said user interface electrical module and said handle member, said covering portion being at least substantially perpendicular to said front panel.

20. The refrigerator door according to claim 18, wherein said covering portion has a through hole formed therein for receiving a fixing member to be connected with said user interface housing for fixing said handle member to said user interface housing.

* * * * *